US005417072A

United States Patent [19]

Silver et al.

[11] Patent Number: 5,417,072

[45] Date of Patent: May 23, 1995

[54] CONTROLLING THE TEMPERATURE IN A CRYOGENIC VESSEL

[75] Inventors: Arnold H. Silver, Rancho Palos Verdes, Calif.; James E. Zimmerman, Boulder, Colo.

[73] Assignee: TRW Inc., Redondo Beach, Calif.

[21] Appl. No.: 148,815

[22] Filed: Nov. 8, 1993

[51] Int. Cl.[6] ..... F17C 13/02

[52] U.S. Cl. ..... 62/49.2; 62/50.1; 62/51.1

[58] Field of Search ..... 62/49.2, 50.1, 51.1

[56] References Cited

U.S. PATENT DOCUMENTS 4,002,039 1/1977 Cramer et al. .
4,136,526 1/1979 Chanin et al. .
4,381,652 5/1983 Kunimoto .
4,462,214 7/1984 Ito .
4,566,283 1/1986 Boese ..... 62/49.2
4,631,928 12/1986 Walker .
4,712,388 12/1987 Sullivan et al. .
4,713,941 12/1987 Toyoda et al. .
4,738,122 4/1988 Walker .
4,967,564 11/1990 Strasser .
4,986,077 1/1991 Saho et al. .
5,060,481 10/1991 Bartlett et al. .
5,101,636 4/1992 Lee et al. ..... 62/49.2
5,150,578 9/1992 Oota et al. .
5,166,776 11/1992 Dederer et al. .
5,176,003 1/1993 Horikawa et al. .

*Primary Examiner*—Ronald C. Capossela
*Attorney, Agent, or Firm*—Charles Berman; S. L. Goldstein

[57] ABSTRACT

A cryogenic device comprises a vessel to be maintained at a cryogenic temperature. The vessel is mounted on a storage tank in a pressure Eight relationship. Cryogenic fluid under pressure is forced into the vessel through a transfer tube. The temperature in the vessel is controlled by flow of cryogenic fluid through the vessel. A throttle valve in a line leading from the cryogenic vessel regulates the cryogenic fluid flow in relation to a sensed temperature in the vessel.

16 Claims, 3 Drawing Sheets

CONTROLLING THE TEMPERATURE IN A CRYOGENIC VESSEL

BACKGROUND

Providing an effective system for cooling electronic or other components or devices to precise and well controlled cryogenic temperatures is valuable. A common method of cryogenic cooling is to use one or more cryogenic fluids.

This invention relates to a device for providing efficient and precise cryogenic cooling over a wide temperature range. In particular, the invention is concerned with a cryostat and the ability to precisely regulate the temperature of a test article in a cryostat connected to source of cryogenic fluid.

Cryostats are commonly storage vessels for cryogenic fluids. The device to be cooled is immersed directly into the storage cryostat. This has two disadvantages: For efficient storage of expensive cryogens such as liquid helium (LHe), the access distance to the cryogenic fluid is several feet. This can reduce the efficiency of the device operation. Direct immersion makes it difficult and inefficient to set and control the temperature at other than the fixed temperature of the cryogen. To overcome the last difficulty, cryostats also are known which flow the cryogen or its vapor at or near the test article. These typically require cumbersome plumbing for transporting the cryogenic fluids and temperature regulation by inefficient heating.

There is a need to provide a cryogenic system which minimizes the disadvantages of known systems.

SUMMARY

This invention provides a cryogenic system which seeks to overcome the disadvantages of known systems.

According to the invention, a cryogenic device comprises a vessel and accompanying components which maintains a test article at a user-selected cryogenic temperature. The vessel is mounted in a pressure tight relationship in direct communication with the cryogenic liquid in a storage tank for a cryogenic fluid. There are means for delivering the fluid to the vessel under the action of pressure in the storage tank. There is a pressure tight cap means for the vessel such that when the cap is located on the vessel, the cap and vessel can withstand pressure from the tank.

Means are also provided for selectively permitting a flow of cryogenic fluid through the vessel. A controlled throttle valve operative with the flow means permits the flow of fluid through the vessel to directly regulate the temperature in the vessel.

In a preferred form of the invention, there is means for sensing the temperature of the test article in the vessel. The throttle valve is operative in response to the temperature sensing means such that the valve measurably opens in a manner that regulates the flow and thereby maintain the temperature at a predetermined level.

Also in a preferred form of the invention, the vessel is a vacuum-insulated container. The vacuum-insulated container includes a vacuum-insulated transfer tube, the transfer tube containing the means for accessing cryogenic fluid from the storage tank.

The mounting means mounts the vacuum-insulated vessel on the storage tank. There is provided a vacuum-insulated tube that is part of the vessel and extends into the storage tank below the level of the cryogenic liquid. An increase in pressure in the storage tank relative to the pressure in the vessel causes a cryogenic liquid to flow towards the vessel thereby cooling the vessel by thermal conduction, convection, and evaporation of the liquid.

The storage tank preferably includes a vapor bleed line. Closure of the bleed line increases the pressure in the storage tank thereby increasing the pressure and causing the cryogenic liquid to travel to the vessel.

The invention covers the device and method for operating the cryogenic system.

The invention is further described with reference to the accompanying drawings.

DRAWINGS

DESCRIPTION

Cryogenic Vessel, Transfer Tube, and Storage Tank

Figure 1:
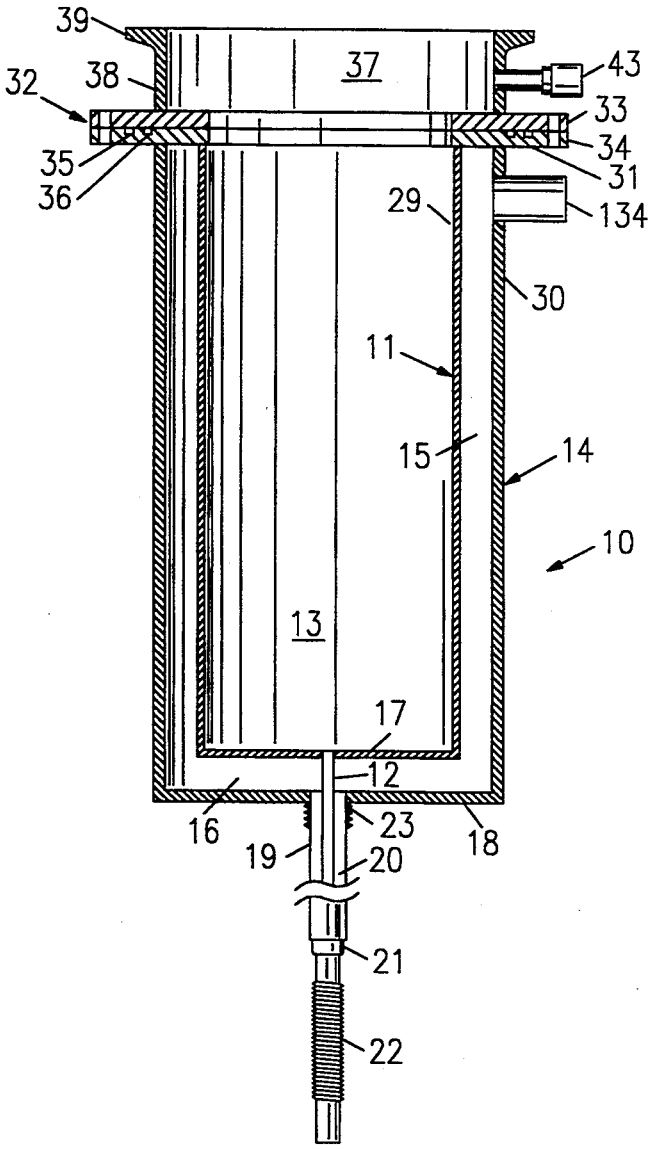
FIG. 1 is a cross-sectional side view of a cryogenic vessel illustrating a vacuum-insulated container and a vacuum-insulated transfer tube.

A cryogenic device 10 as shown in FIG. 1 includes a cylindrical vessel 11 and provides a specified region inside the vessel to be maintained at a specific cryogenic temperature higher than that of the cryogenic liquid in the storage tank. Associated with the device is a fluid transfer tube 12 which connects to the interior 13 of the vessel 11. The vessel 11 is contained within a cylindrical housing 14. A vacuum is drawn in the space 15, 16 between the walls of the vessel 11 and the walls 14 of the container insulation of the vessel 11. The transfer tube 12 passes through the vacuum space 16 below a base 17 of the vessel 11 and above a base 18 for the vacuum insulated container 14.

The transfer tube 12 is also vacuum insulated. It is surrounded by a tube 19 and a vacuum exists in space 20 between the transfer tube 12 and the surrounding tube wall 19. The vacuum in space 15 is coextensive with the vacuum in space 20. The outer tube 19 reduces in diameter at the end 21 and merges with a bellow system 22 to take up differential contractions between the inner transfer tube 12 and the outer tube 19 caused by temperature differential between inner and outer tubes 20 and 19, respectively.

An O-ring fixture is provided on the top port of the storage tank which seals the outer surface of tube 19 at 23, adjacent and underneath the base wall 18 of the vacuum insulated cylindrical container 14. This permits for mounting of the vessel 11 in a pressure tight relationship with a storage tank 24. Such O-ring or other fixture are commercially available, such as quick connect fixtures. In this manner, the vessel 11 is mounted directly with the storage tank 24.

Figure 4:
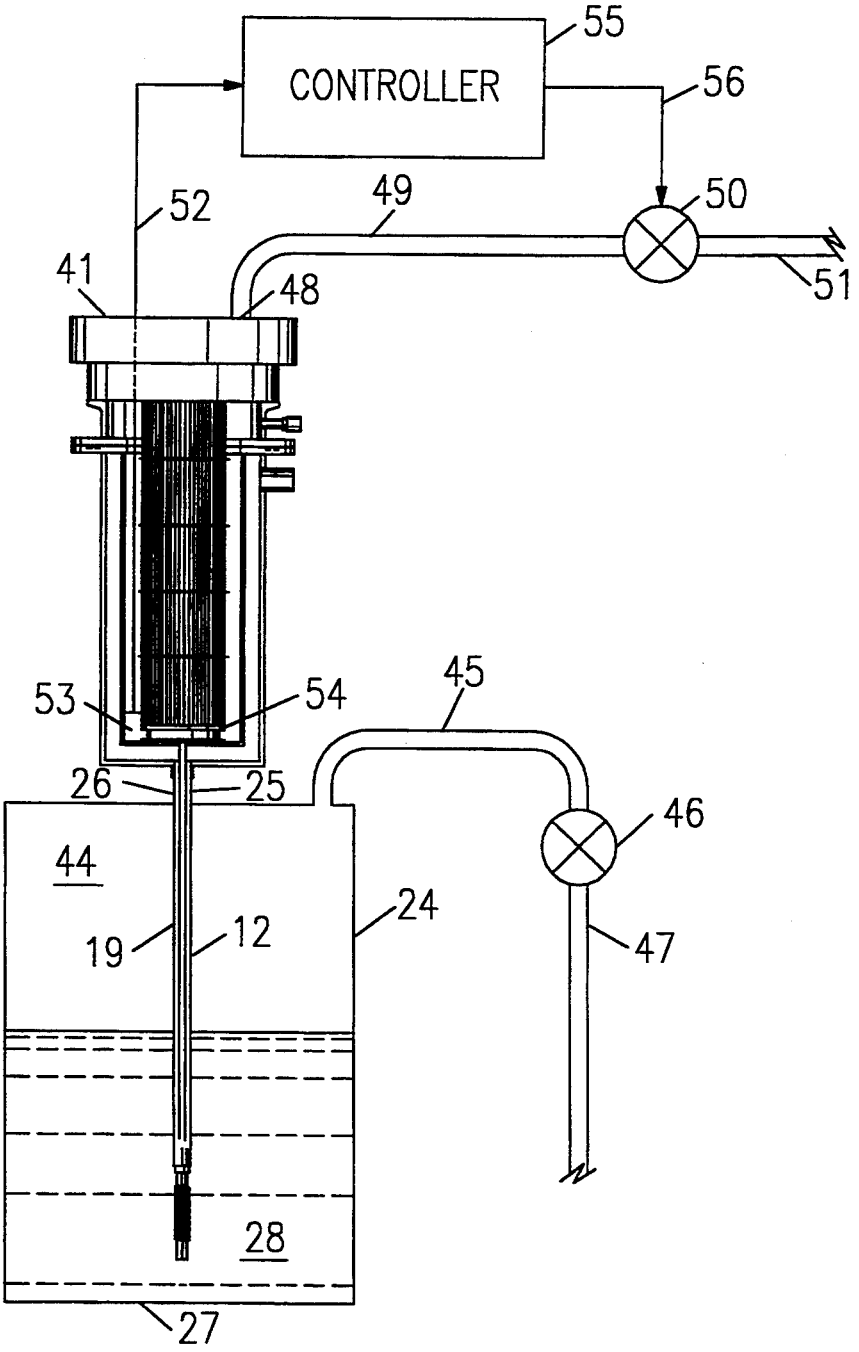
FIG. 4 is a flow diagram illustrating a cryogenic vessel and storage tank with a throttle valve and controller connected with the cryogenic vessel.

The transfer tube 12 inside the insulated outer tubing 19 extends towards the bottom 27 of the storage tank 24 (FIG. 4). This permits for accessing fluid 28 from the tank 24 and for delivering the fluid 28 from the tank 24 to the vessel 11 under action of the pressure in the tank 24.

The upwardly extending cylindrical walls 29 of the vessel 11 and walls 30 of insulated container 14 extend to an upper position 31 and are sealed with a vacuum-tight cap mechanism 32. There are two ring-like components 33 and 34 which are anchored together to form a seal at the top of the space 15. This closes the space so that a vacuum can be drawn in the space 15. A pump-out port 134 (FIG. 1) is provided in the wall 30 such that the vacuum can be created in the space 15. Between the components 33 and 34 there is one circumferential seal 35 to facilitate and insure the vacuum condition in space 15.

Figure 2:
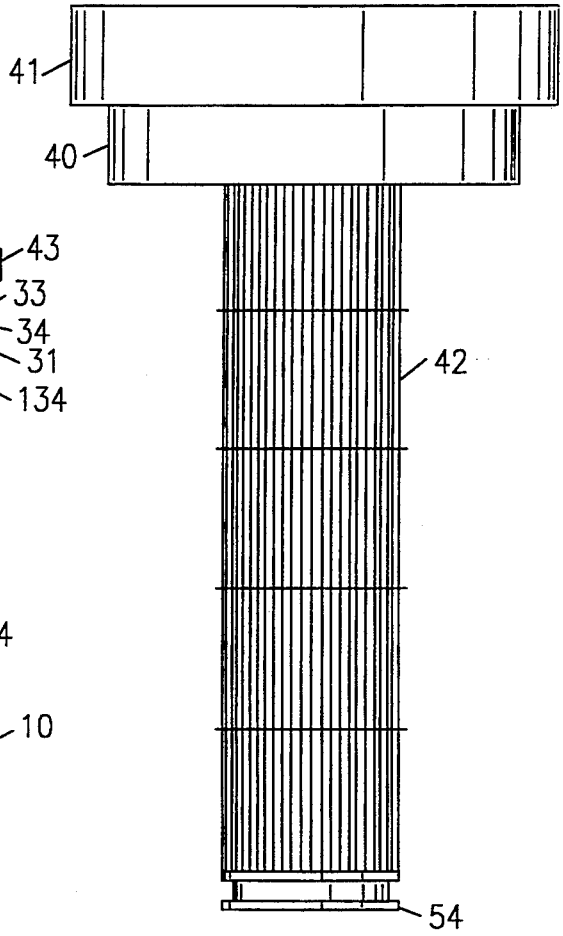
FIG. 2 is a side view of a test-support fixture showing the electrical leads connected to a device to be tested in the cryogenic vessel, the device being located towards the bottom of the vessel.
Figure 3:
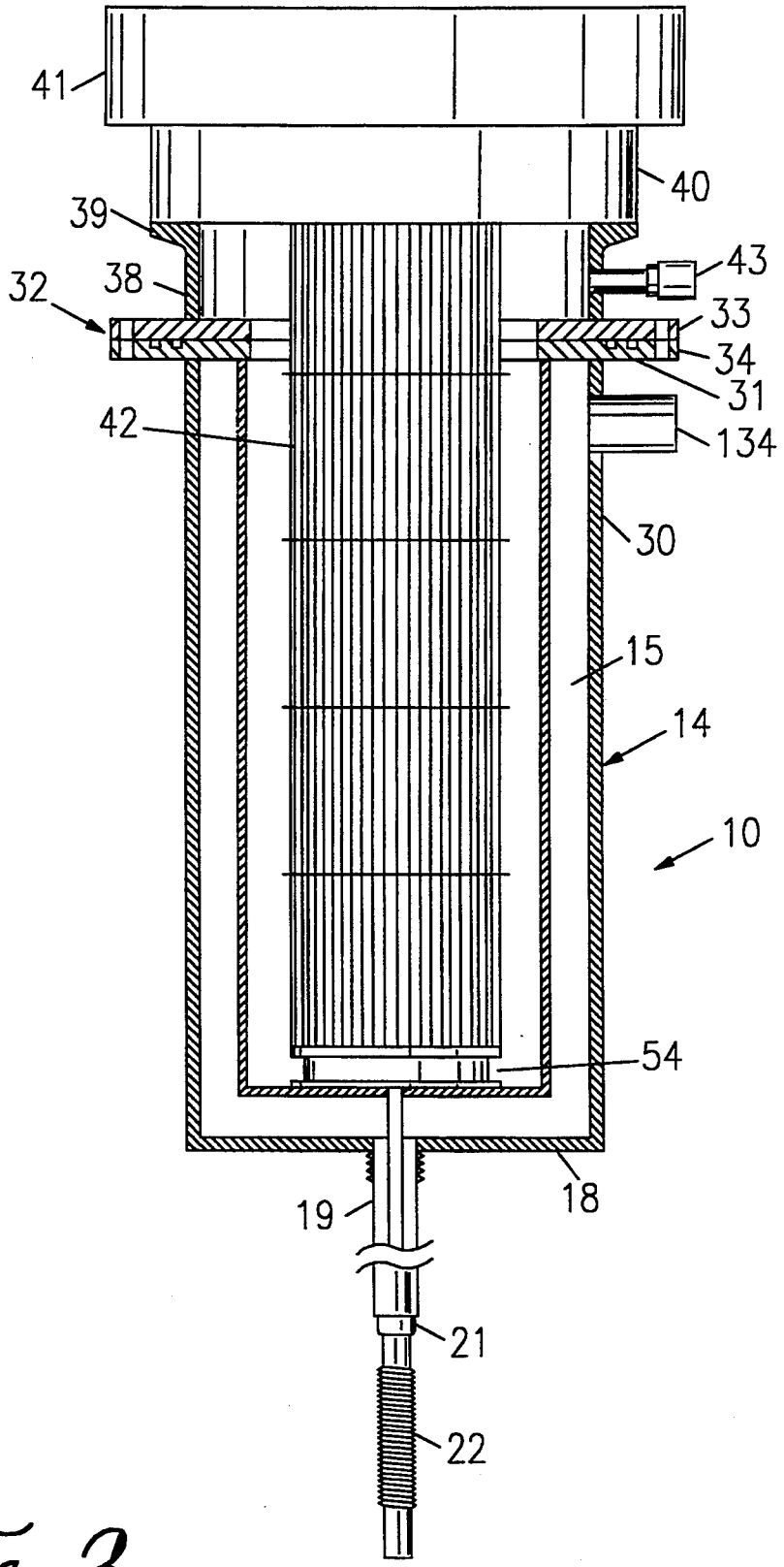
FIG. 3 is a cross-sectional view illustrating the cryogenic vessel with the test-support fixture juxtaposed the mating top plate of the vessel, the device being located towards the bottom of the cryogenic vessel.

Above component 33, the space 37 also forms part of the interior of the cryogenic vessel 11. There is no vacuum insulated container in this portion of the cryogenic vessel 11. The wall 38 provides the outside and inside surface for this portion 37 of the cryogenic vessel 11. On the top of wall 38 there is a circular flange 39 which is used to cooperate with a mating flange 40 on a cap 41 (FIG. 2). From the wall 38 there is also a gas flow control port 43 which communicates with the space 37 and, in turn, the space 13 of the vessel 11.

The storage tank 24, as shown in FIG. 4, contains cryogenic fluid 28 which may be partly in liquid form in the lower portion of the tank 24 and gaseous form in the upper portion 44 of the tank 24.

The tank 24 also includes a vapor bleed line 45 which is tapped into the top of the tank 24. In general, either a check valve, or a spring- or gravity-loaded pressure regulating valve 46 is used to maintain a fixed positive pressure in tank 24.

When the temperature regulated cryostat is not in use and opened to remove the test fixture 40-42 (FIG. 2), the flow regulating means is turned off to conserve the stored cryogen. The element 42 comprises the electrical connections to the device 54 under test. Before opening the cryostat and removing the test fixture, control valve 50 is closed and pressure regulating valve 46 is opened to interrupt the flow of cryogenic fluid from 24 to 13. Liquid or gas may flow downwardly from the space 13 down tube 12 and return as fluid into the bottom of the tank 24. Such downward flow may, in different circumstances, be gas or a combination of liquid and gas.

Cryogenic Fluid Flow Control

The cap 41 includes an outlet 43 for permitting flow of cryogenic fluid through the vessel 11. A cryogenic fluid gas outlet tube 49 is connected to port 43 with an in-line control valve 50 having an outlet vent 51.

The cap 41 (FIG. 4) also includes means for an electrical sensing line 52 connected to the temperature sensor 53 in the space 13 of the vessel 11. The temperature sensor 53 is associated with the device-under-test 54 located in the space 13 such that the temperature of the device 54 can be measured by the sensor 53. The device 54 is located adjacent or on the base 17 of the vessel 11. The temperature generated signal is transmitted along line 52 to a controller 55 which acts through line 56 to operate the control valve 50.

Should it be desired to increase the temperature in the vessel 11 (FIG. 1) then control valve 50 is closed such that the flow through line 49 is more restricted. Should it be necessary to reduce the temperature, then the control valve 50 is opened so that the flow through line 49 increases.

The control system is connected for the following operation. A decrease in the temperature in the cryostat vessel 11 below a set level, which is caused by too large a flow of cryogenic fluid, results in a partial or complete closing of the throttle valve 50. This causes a reduction of the flow of cryogenic fluid. This in turn changes the temperature in the direction of the predetermined set level or value. Conversely, a change of temperature above a set value results in partial opening of the throttle valve 50. Additional cooling brings the temperature down towards the set value.

Temperature Control

Depending on the desired temperature in the space 13, the vessel 11 can be filled with liquid and/or gas. Usually, there is liquid helium around the device 54 to maintain the temperature at about 4 Kelvin.

The particular cryogenic liquid varies according to the desired cryogenic temperature range which is sought to be obtained in the vessel 11. The fluid is selected as follows:

| Fluid | Temperature |
|---|---|
| helium | 4 Kelvin and greater |
| nitrogen | 77 Kelvin and greater |
| hydrogen | 20 Kelvin and greater. |

The flow through the vessel 11 is determined by the number of liters of gas per second required to cool the device 54 (FIG. 4) and associated test fixture in relation to the temperature sensed by the sensor 53. There can be variable temperature control by varying the flow of cryogenic fluid through line 49 as determined by the control valve 50. The controller 55 can operate in accordance with a predetermined program or manual adjustment to regulate the flow through the gas line 49 and thereby control the temperature of the device 54.

A feedback loop containing the temperature sensor 53, and controller 55 and control valve 50 operates with commercially available controllers. An electrical signal from the sensor 53 gives a signal output to the controller 55. There may be calibration tables setup for operating the controller 55 and the control valve 50 as necessary. The output signal from the controller 55 could be a proportional driver, system outputting on an on/off basis or an integral, or derivative control system. A typical controller is that supplied by Lake Shore Cryotronics, Inc. of Westerville, Ohio; e.g., Model 330—Autotuning Temperature Controller.

The temperature sensor 53 could be a conventional semiconductor diode, or carbon resistor. Many suppliers of temperature controllers also supply mating and calibrated temperature sensors.

The electrically controlled throttle valve 50 is obtained from MKS Instruments, Inc. of Andover, Mass.; e.g., Part 154A-200LSV, Flow Control Valve.

In one other form of control of the temperature of the device 54, the check valve 46 can be opened and closed as desired. In some embodiments, the controller 55 may operate with valve 46 independently. The system may not need valve 50.

In other cases, the controller 55 can operate with both check valve 46 and control valve 50 to regulate the temperature in the vessel 11.

It would be possible in some embodiments to have a situation where the flow in the vessel 11 is controlled by means of fluid pressure in the storage tank 24. In such situations there will be a fixed orifice at the position of valve 50.

The system of the invention uses a precise amount of flow of cryogenic fluid necessary to maintain any particular temperature. The flow is used to regulate the temperature in vessel 11 and particularly of device 54.

System Advantages

A major advantage of this system is the ability to control the temperature by controlling the fluid flow external to the cryostat. Previous systems typically control temperature by drawing the temperature below the desired set point, and then adding heat from an electrical heater installed in the cryostat. The flow-control system described here has two important advantages: it uses the minimum amount of cryogen to maintain a predetermined temperature without the use of a heater. Elimination of the heater further reduces the load on the cryostat because it eliminates the thermal conduction load of the electrical leads into the cryostat. It also simplifies the cryostat and test fixture construction, and eliminates noise and interference from the heater control signal in the cryostat. Since the controller and control valve can be placed remotely from the cryostat, potential electrical noise and disturbance can be reduced as far as desired.

This system achieves a high transfer efficiency of communicating the cryogenic temperature to the cryogenic vessel. The transfer tube 12 is the minimum possible length and is enclosed within the neck 25 of the storage tank 24. These features minimize the heat loss and thereby, consumption of the cryogenic fluid. During standby or when changing a device 54 in the vessel 11, the top of the cryostat vessel 11 can be sealed. When this is done and the procedures described hereinabove are implemented, the cryogenic fluid in vessel 11 transfers back into the storage tank 24. No further liquid cryogenic fluid transfer takes place. Thus, the liquid cryogenic fluid is used only when it is actually needed. This makes the system advantageous for frequent, intermittent and interrupted use. There is greater efficiency in cryogenic use, and faster turnaround time between changing devices 54.

There is a more efficient electrical system by virtue of shorter electrical leads 42. The device 54 under test in the vessel 11 is connected with relatively short electrical leads through the cap 41. In this sense the length of the cryostat device 10 from the bottom plate 18 to the top flange 38 is about 12 inches even for operation at liquid helium temperature. The leads are easily less than about 12 inches in length. By having these relatively short electrical leads, the electrical performance of the system is improved. This is particularly advantageous for high-frequency electrical signals.

General

The vessel 11 can be used to contain any device which needs a cryogenic environment. For example, such as cryoelectronic instruments, digital processors components and modules, cryo CMOS, cooled GaAs and HEMT, IR sensors, and superconductor circuits require such environment.

The invention is to be determined solely in terms of the following claims.

We claim:

1. A cryogenic device comprising:

a vessel to be maintained at a predetermined cryogenic temperature, said vessel being in communication with a supply storage tank of cryogenic fluid;

means for mounting the vessel in pressure tight relationship with the storage tank;

means for delivering fluid from the tank to the vessel;

temperature control means comprising valve means for selectively permitting the flow of cryogenic fluid from said storage tank into the vessel, temperature sensors juxtaposed said vessel for sensing the temperature in the vessel, controller means responsive to said sensor means for controlling the flow of cryogenic fluid through said vessel, whereby the temperature in said vessel is maintained at said predetermined level as a function of the rate of flow of cryogenic fluid there through.

2. A device as claimed in claim 1 including removable cap means for securing the vessel in pressure secure relationship to said storage tank.

3. A device as claimed in claim 1 including a throttle valve controlled by said controller means for regulating the flow rate of cryogenic fluid through the vessel.

4. A device as claimed in claim 1 wherein the vessel is contained in a vacuum insulated container.

5. A device as claimed in claim 1 wherein the means for delivering fluid from the storage tank to the vessel includes a vacuum insulated transfer tube that reaches the bottom of the storage tank, such that pressure in the storage tank causes a cryogenic liquid to flow towards the vessel.

6. A device as claimed in claim 1 wherein the storage tank is equipped with means for controlling the pressure within the tank necessary to deliver fluid to the vessel.

7. A device as claimed in claim 1 wherein the control means includes a feedback loop, the feedback loop including the temperature sensing means, the temperature controller, and the throttle valve, said throttle valve being electrically controlled in response to the temperature sensing.

8. A device as claimed in claim 1 including means for selectively sealing the vessel, thereby to restrict the flow of fluid from the tank into the vessel and to cause cryogenic fluid to return from the vessel back into the storage tank.

9. A temperature control device for controlling the environment within a vessel at a predetermined cryogenic temperature comprising:

a source supply of cryogenic fluid stored under pressure;

means for securing said vessel in pressure secure communication with said storage tank establishing an operating pressure between said storage tank and said vessel;

means for controlling the rate of cryogenic fluid flow through said vessel comprising:

valve means for removing fluid from said device thereby altering said operating pressure, sensing means inside said vessel for generating signals representing the level of temperature inside said vessel, controller means for receiving said signals and controlling the operation of said valve means to regulate the flow of fluid through the vessel and thereby controlling the temperature therein.

10. The device as claimed in claim 9 wherein the vessel is contained within a vacuum insulated container.

11. A device as claimed in claim 10 wherein the vacuum insulated container includes a vacuum insulated transfer tube, the tube being the means for delivering fluid from the storage tank to the vessel.

12. A device as claimed in claim 9 wherein the valve means is a throttle valve electrically controlled in response to the temperature sensing means in the vessel.

13. A method of operating a cryogenic device having a vessel to be maintained at a predetermined cryogenic temperature, the vessel being in a pressure tight relationship with a pressurized storage tank for supplying cryogenic fluid comprising:

accessing fluid from the tank and delivering the fluid from the tank to the vessel under pressure, sensing for sensing changes in the predetermined temperature in the vessel, altering the level of pressure in the device by removing fluid from the device in response to the temperature changes in the vessel, by throttling the exhaust flow of cryogenic fluid in response to the temperature such that a change in temperature in the vessel regulates the flow of cryogenic fluid from the vessel.

14. A method as claimed in claim 13 wherein an increase in pressure in the storage tank relative to the pressure in the vessel causes a cryogenic liquid to flow towards the vessel thereby cooling the vessel by thermal conduction, convection, or evaporation of the liquid.

15. A method as claimed in claim 13 including selectively exhausting vapor from the storage tank, and wherein inhibiting the exhaust increases the pressure in the storage tank thereby to increase the pressure for liquid to travel to the vessel.

16. A method as claimed in claim 13 including feeding back a signal between the temperature sensing and the throttling and thereby electrically controlling throttling in response to the temperature.

* * * * *